US010234083B2

(12) United States Patent
Katsaros

(10) Patent No.: US 10,234,083 B2
(45) **Date of Patent: *Mar. 19, 2019**

(54) ADJUSTABLE SOLAR CHARGED LAMP

(71) Applicant: Stephen Katsaros, Denver, CO (US)

(72) Inventor: Stephen Katsaros, Denver, CO (US)

( * ) Notice: Subject to any disclaimer, the term of this patent is extended or adjusted under 35 U.S.C. 154(b) by 124 days.

This patent is subject to a terminal disclaimer.

(21) Appl. No.: 15/220,401

(22) Filed: Jul. 27, 2016

(65) Prior Publication Data

US 2016/0334068 A1 Nov. 17, 2016

Related U.S. Application Data

(63) Continuation of application No. 14/920,893, filed on Oct. 23, 2015, now Pat. No. 9,429,281, which is a (Continued)

(51) Int. Cl.

| | |
|---|---|
| ***F21L 4/08*** | (2006.01) |
| ***F21S 9/03*** | (2006.01) |
| ***F21V 21/30*** | (2006.01) |
| ***F21V 3/02*** | (2006.01) |
| ***F21V 17/12*** | (2006.01) |

(Continued)

(52) U.S. Cl.

CPC ..... *F21L 4/08* (2013.01); *F21S 9/037* (2013.01); *F21V 3/02* (2013.01); *F21V 17/12* (2013.01); *F21V 21/0832* (2013.01); *F21V 21/30* (2013.01); *F21V 21/08* (2013.01); *F21Y 2101/00* (2013.01); *F21Y 2105/10* (2016.08); *F21Y 2115/10* (2016.08)

(58) Field of Classification Search

CPC ..... F21S 8/08; F21S 8/036; F21S 9/03; F21S 9/035; F21S 9/037; F21V 21/08; F21V 21/0885; F21V 21/14; F21V 21/145; F21V 21/26; F21V 21/28; F21V 21/30; F21L 14/02

See application file for complete search history.

(56) References Cited

U.S. PATENT DOCUMENTS 2,980,889 A * 4/1961 Meissner ..... F21L 4/00 340/321
3,767,911 A * 10/1973 Oakley ..... F21L 19/00 362/186

(Continued)

FOREIGN PATENT DOCUMENTS

| | | |
|---|---|---|
| CN | 2560826 | 7/2003 |
| CN | 1622899 | 6/2005 |

(Continued)

*Primary Examiner* — Julie Bannan
(74) *Attorney, Agent, or Firm* — Eagle IP Limited; Jacqueline C. Lui

(57) ABSTRACT

An adjustable solar-charged lamp configured to collect and store energy from the sun and to illuminate the lamp with the stored energy, the lamp including a housing, a lens engaged with the housing; a solar collector attached to the housing; a battery and a light emitting device disposed within an interior of the housing and in communication with the solar collector; and a hanger assembly pivotally attached to the housing, wherein the solar collector is repositionable to the hanger assembly to provide maximum exposure to a light source, such as the sun.

18 Claims, 6 Drawing Sheets

Related U.S. Application Data continuation of application No. 13/884,968, filed as application No. PCT/US2011/060503 on Nov. 13, 2011, now Pat. No. 9,200,767.

(60) Provisional application No. 61/413,408, filed on Nov. 13, 2010.

(51) Int. Cl.

| | |
|---|---|
| *F21V 21/08* | (2006.01) |
| *F21Y 101/00* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 4,281,369 | A | 7/1981 | Batte | |
| 5,055,984 | A | 10/1991 | Hung et al. | |
| 7,118,245 | B1 * | 10/2006 | Herrington | F21L 4/00 362/185 |
| 7,674,002 | B1 | 3/2010 | Wang | |
| D621,541 | S | 8/2010 | Hamel | |
| D638,571 | S | 5/2011 | Chilton | |
| D641,917 | S | 7/2011 | Toratani | |
| 8,668,349 | B2 | 3/2014 | Richardson | |
| 2005/0146874 | A1 | 7/2005 | Cech | |
| 2006/0109647 | A1 * | 5/2006 | Liu | F21S 9/037 362/183 |
| 2006/0227542 | A1 * | 10/2006 | Richmond | F21V 21/0824 362/183 |
| 2006/0279956 | A1 * | 12/2006 | Richmond | F21S 9/037 362/374 |
| 2007/0091594 | A1 * | 4/2007 | Soon | F21L 4/00 362/183 |
| 2007/0175085 | A1 | 8/2007 | Chen | |
| 2007/0274066 | A1 | 11/2007 | Lodhie et al. | |
| 2008/0170389 | A1 | 7/2008 | Lavigne | |
| 2009/0251892 | A1 | 10/2009 | Hatti et al. | |

FOREIGN PATENT DOCUMENTS

| | | | |
|---|---|---|---|
| CN | 201302058 | Y | 9/2009 |
| CN | 301744450 | S | 11/2011 |
| DE | 202005013959 | | 12/2005 |
| DE | 202009012026 | | 12/2009 |
| EP | 1500870 | | 1/2005 |
| JP | 2005216495 | | 8/2005 |
| KR | 10-2007-0054466 | | 5/2007 |
| KR | 10-2007-0017894 | | 8/2008 |
| WO | 2009/149460 | | 12/2009 |

* cited by examiner

ADJUSTABLE SOLAR CHARGED LAMP

CROSS-REFERENCE TO RELATED APPLICATIONS

U.S. Provisional Patent Application No. 61/413,408 filed Nov. 13, 2010

FEDERALLY SPONSORED RESEARCH OR DEVELOPMENT

Not Applicable

INCORPORATION BY REFERENCE OF MATERIAL SUBMITTED ON A COMPACT DISK

Not Applicable

SPECIFICATION

To All Whom it may Concern

Be it known that I, Stephen B. Katsaros, a citizen of the United States, have invented new and useful improvements in an adjustable solar charged lamp as described in this specification. I claim benefit of my U.S. Provisional Patent Application No. 61/413,408 filed on Nov. 13, 2010.

BACKGROUND

In the past, location of a light source has been limited to locations with an available electrical connection. Examples of these traditional locations are offices, homes, schools, public sidewalks, etc. All of these examples are located where an electrical connection is readily available and attached to a larger electrical grid. Often, people do not have access to an electrical connection or the connection operates intermittently. Examples of non-electrified locations are modest dwellings, camping tents, outdoor gardens, rural areas, and countless other locations throughout the world. In the past, portable lamps have been developed to illuminate these non-electrified locations. Examples of portable lamps include battery-powered flashlights, battery-powered foot-path lights, and combustible torches such as candles and gas-powered lanterns.

FIELD OF THE INVENTION

Various types of solar lights are known in the prior art. However, what is needed is an adjustable solar charged lamp that has a repositionable solar collector and that includes a housing and a hanger assembly that is frictionally attached to the housing to permit the repositioning of the solar collector for maximum exposure to a light source.

SUMMARY

The present adjustable solar-charged lamp is configured to collect energy from the sun, store the energy, and illuminate the lamp with the stored energy. The lamp includes a housing having an exterior and an interior; a lens engaged with the housing; a solar collector attached to the housing; a battery electrically interfaced with the solar collector; a light emitting device electrically engaged with the battery; and a hanger assembly pivotally attached to the housing. The solar collector is adjustable relative to the hanger assembly to allow for maximum exposure to a light source, such as the sun.

DETAILED DESCRIPTION OF THE DRAWINGS

With reference now to the drawings, and in particular FIGS. 1 through 9 thereof, the instant adjustable solar-charged lamp employing the principles and concepts of the present adjustable solar-charged lamp and generally designated by the reference number 10 will be described.

The problem of repeatedly illuminating a dark location is solved by providing a solar-charged lamp, configured to resemble a traditional incandescent light bulb and to produce light equivalent to a traditional incandescent light bulb. The lamp has an electronics assembly adjustably supported by a hanger assembly such that the entire lamp is repositionable to track with the sun in order to maximize the recharging of the battery.

Figure 1:
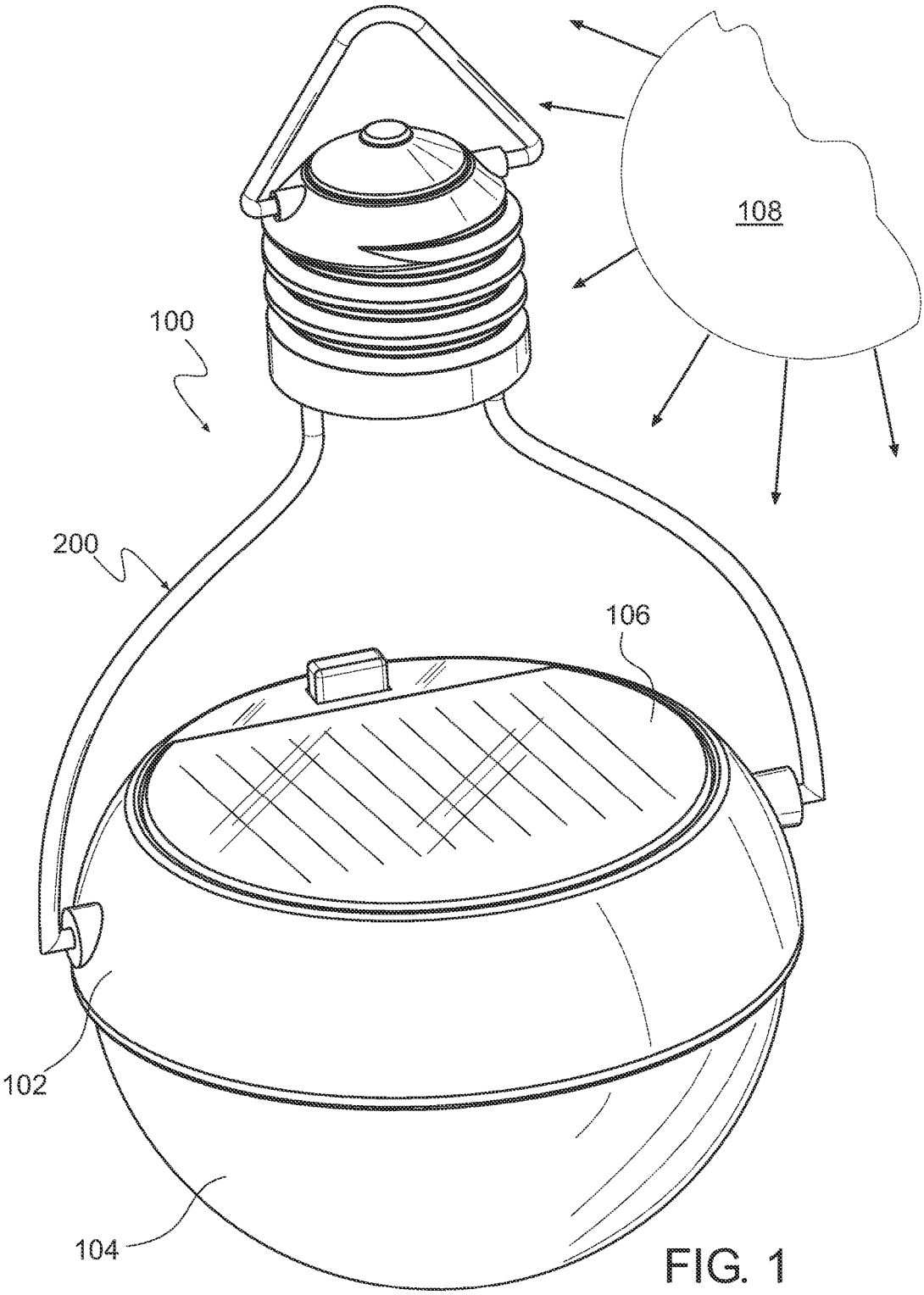
FIG. 1 is an isometric view of one embodiment of an adjustable solar charged lamp.

With reference to FIG. 1 showing an isometric view of the adjustable solar-charged lamp 100 pivotably supported by a hanger assembly 200, the lamp 100 includes a housing 102, having an exterior 101 and an interior 103, and a lens 104. The lens 104 is substantially the shape of a traditional incandescent light bulb. Positioned on the housing 102 is at least one solar collector 106 configured to receive photons and to supply electricity to internal components of the lamp 100. The lamp 100 is adjustably supported by the hanger assembly 200. The solar collector 106 is repositionable to track with direct view of a light source 107, such as the sun 108 in order to achieve maximum solar collection.

Figure 2:
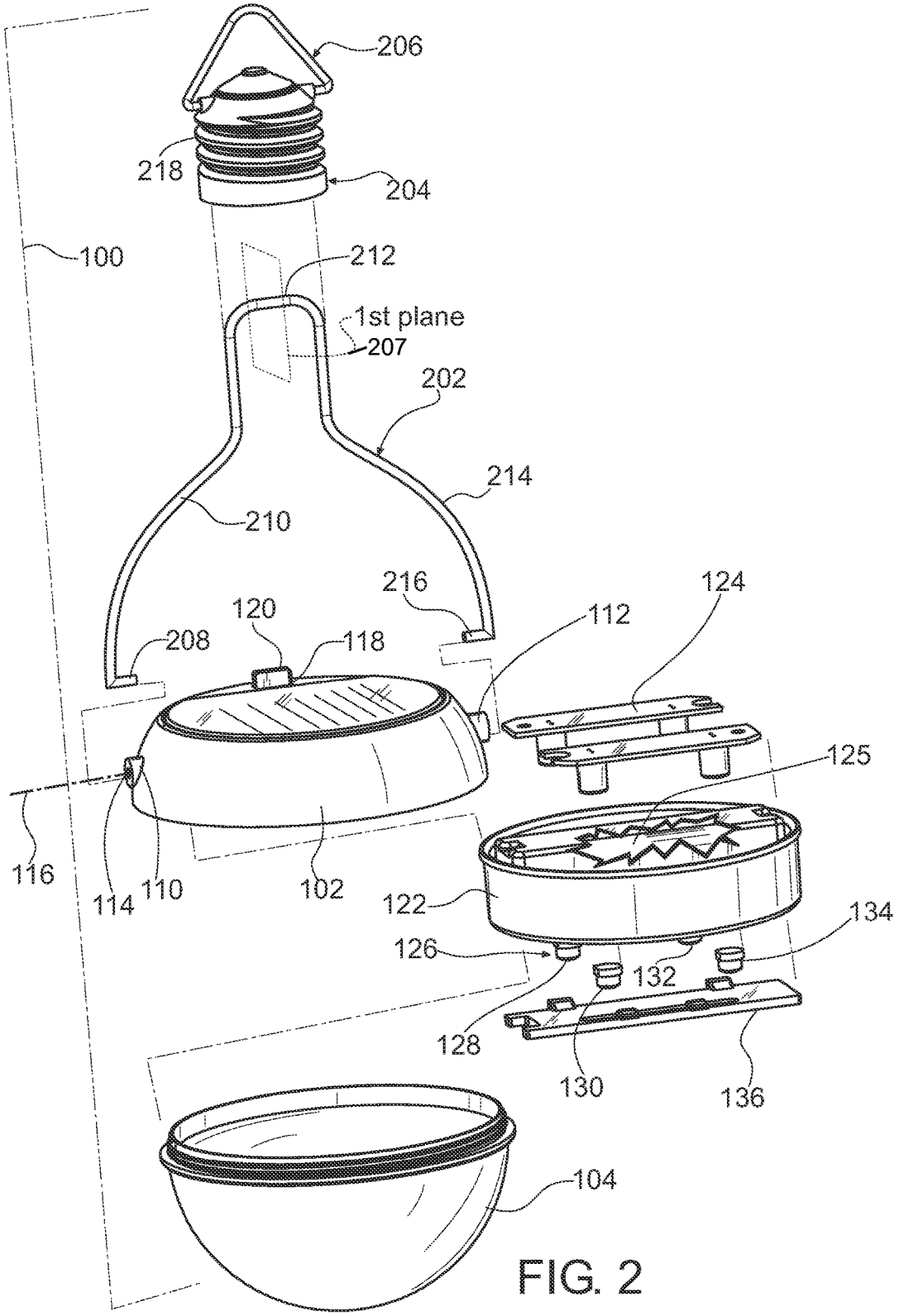
FIG. 2 is an exploded isometric view of the lamp.

With reference to FIG. 2 showing an exploded view of the adjustable solar-charged lamp 100, the housing 102 includes a first pivot support 110 and a second pivot support 112. Each of the pivot supports 110, 112 has a hole 114 formed therein. These pivot supports 110, 112 are coaxial and generally define a pivot axis 116. The housing 102 includes a switch opening 118 configured to receive a switch 120 therethrough. The switch 120 activates and alternately deactivates the adjustable solar-charged lamp 100. The solar collector 106 is disposed on the housing 102 in a location, such as proximal to the switch 120 as illustrated; provided, however, that the solar collector 106 is repositionable to track with a light source, such as the sun 108. Alternately, the solar collector 106 and the switch 120 can be disposed in a variety of locations, such as in a location remote from the housing 102 depending on the specific configuration of the adjustable solar-charged lamp 100. The adjustable sola charged lamp 100 is further provided with an electronics bracket 122 to which various components are interfaced, such as a circuit board 124; a battery 125; at least one light emitting device 126, such as individual light emitting diode 128, 130, 132, 134, disposed within the housing 102 interior 103; and a battery door 136. These various components operationally communicate with the solar collector 106 and the switch 120 to ultimately provide light from the light emitting devices 126.

With continued reference to FIG. 2, the hanger assembly 200 includes a yoke 202, a cap 204 and a loop 206. The yoke 202 includes a first pivot 208, a first arm 210, web 212, a second arm 214, and a second pivot 216 as illustrated. The first pivot 208 and the second pivot 216 frictionally engage the first and second pivot supports 110, 112. The yoke 202 is formed out of a spring steel round stock; however, the yoke can be manufactured out of any of a variety of materials using common manufacturing techniques, such as injection molding. In general, and as discussed in detail later herein, the yoke 202 attaches to the housing 102 at the first pivot support 110 and the second pivot support 112 to allow the housing 102 to be pivotably attached to the hanger assembly 200. In order to enable temporary support in a location, such as a room or outside, the cap 204 is attached to the yoke 202. The cap 204 can be attached with a screw. The loop 206 is attached to the cap 204 to provide a feature for hanging the entire adjustable solar-charged lamp 100 on a protrusion, such as a nail, or a tree branch. The loop 206 can be pivotally attached to the cap 204. The cap 204 can include a thread 21, as illustrated, to enable the adjustable solar-charged lamp 100 to be threaded into a receiving socket (not shown). The receiving socket is not provided with electricity, but rather for mechanical attachment.

Figure 3:
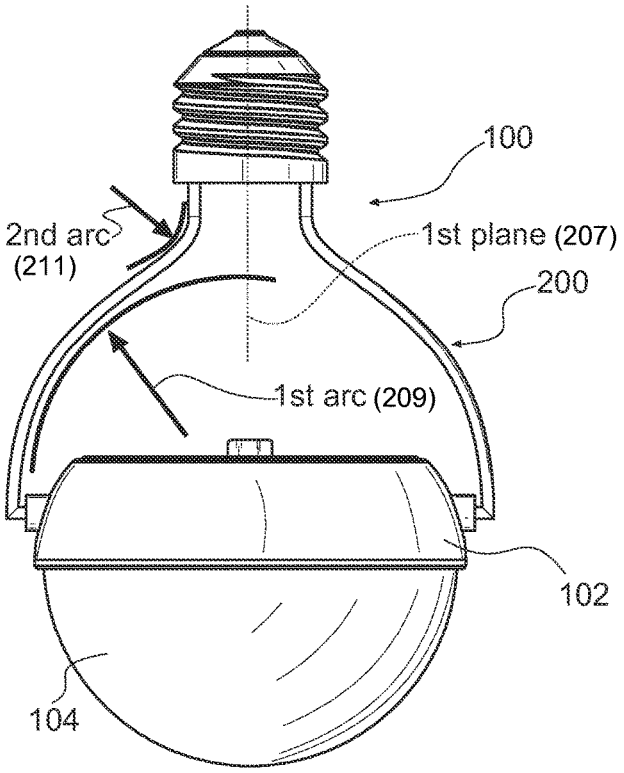
FIG. 3 is a front elevation view of the lamp.

With reference to FIG. 3 showing a side elevation view of the adjustable solar-charged lamp 100, the housing 102, lens 104 and hanger assembly 200 are collectively configured to form a profile that resembles a traditional incandescent light bulb. As illustrated in FIG. 3, the loop 206 can be removably attached to the cap 204 to allow the adjustable solar-charged lamp 100 to be threaded into a socket as described hereinabove. As shown in FIGS. 2 and 3, the hanger assembly 200 defines a first plane 207 intersecting the hanger assembly 200 yoke 202 web 212 with the lamp 10 including a first arc 209 formed in the first arm 210 adjacent to the first pivot 208 and a second arc 211 formed in the first arm 210 between the first arc 209 and the web 212. The second arc 211 is smaller than the first arc 209 and the second arm 214 is a mirror-copy that is symmetrical about the first plane 207.

Figure 4:
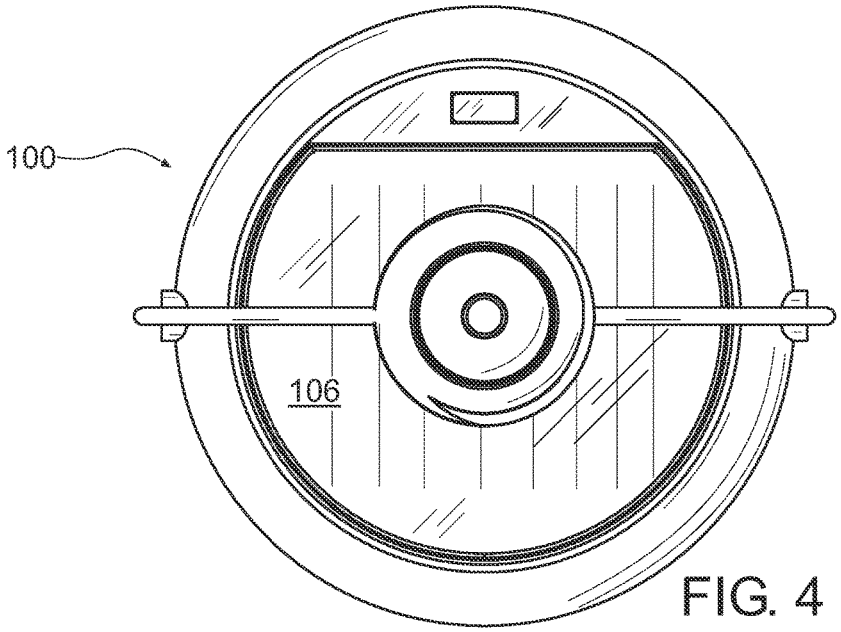
FIG. 4 is a top plan view of the lamp.

With reference to FIG. 4 showing a top plan view of the adjustable solar-charged lamp 100, the solar collector 106 is a flat planar collector configured to capture energy from the sun and to convert the energy to electricity that is ultimately stored in the battery. There are many types of solar collectors 106; however one particular type that has proven to be durable and useful is a polycrystalline photovoltaic (PV) for generating electrical power by converting solar radiation into direct current electricity using semiconductors that exhibit the photovoltaic effect. Alternative solar collectors include, for example, monocrystalline silicon, amorphous silicon, cadmium telluride, and copper indium selenide/sulfide.

Figure 5:
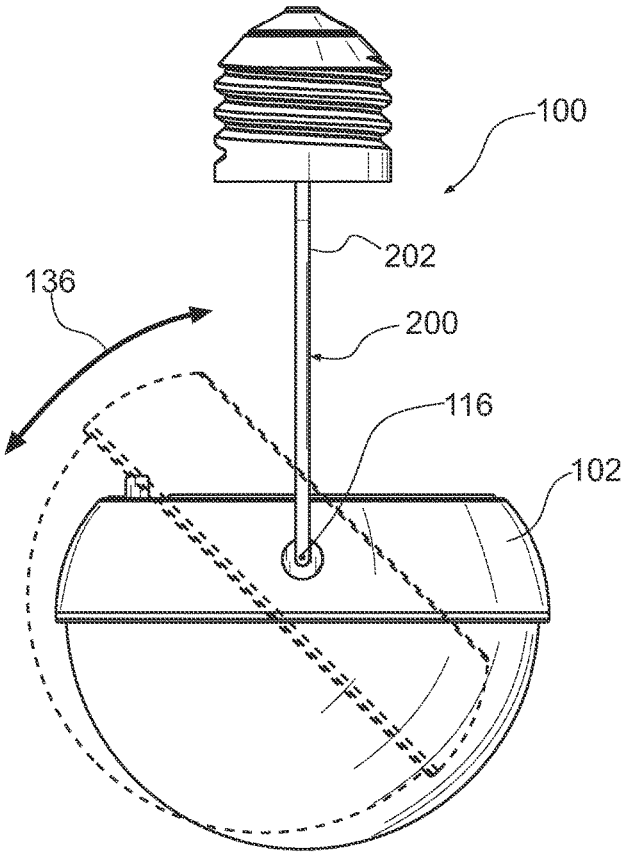
FIG. 5 is a side elevation view of the lamp.

FIG. 5 shows a side elevation view of the adjustable solar-charged lamp 100 with the housing 102 in a horizontal position and an alternate position, illustrated by the phantom lines. As shown in FIG. 5, the adjustable solar-charged lamp 100 is configured such that the housing 102 and all components inherently interfacing therewith can be rotated, as illustrated by arrow 136, about the pivot axis 116. An infinite number of locations of the housing 102 exist; however, one such location is illustrated by the phantom lines in FIG. 5. As can be appreciated by those skilled in the art, the process of adjusting the housing 102 about the pivot axis 116 requires overcoming any force imparted by the yoke 202 on the housing 102.

Figure 6A:
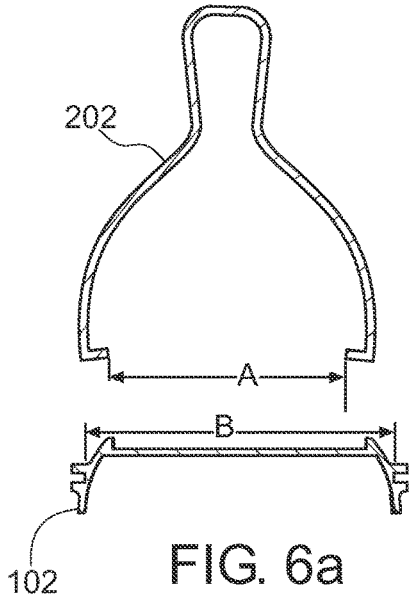
FIGS. 6*a* and 6*b* are a first and second cross-sectional view of a housing and a yoke cooperating to enable the housing to pivot relative to a hanger assembly.
Figure 6B:
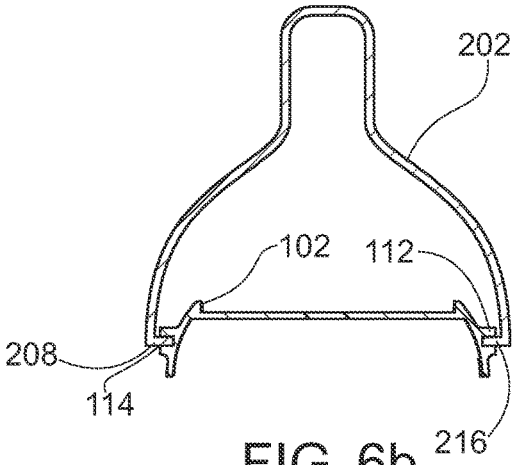

FIG. 6 shows a simplified and illustrative view of the yoke 202 and the housing 102 before the yoke 202 and the housing 102 are interfaced. As illustrated in FIG. 6, the yoke 202 can, for example, have a naturally relaxed configuration with a 'yoke separation distance' noted as "A" that interfaces with a 'housing separation distance' noted as "B". In one configuration, the yoke separation distance A is less than the housing separation distance B so that upon interfacing as illustrated in FIG. 6*b*, the yoke 202 imparts a frictional force on the housing 102. The frictional force is utilized to grip the housing 102 in a particular orientation relative to the hanger assembly 200. In order to clearly articulate the interaction between the yoke 202 and the housing 102, the yoke first pivot 208 is inserted into the housing first pivot support hole 114. In a similar manner, the yoke second pivot 216 is inserted into the hole located in the housing second pivot support 112. Thus, the yoke 202 selectively frictionally engages the housing in a selected orientation relative to the hanger assembly 200 wherein the selected orientation is directed toward direct view of the light source, such as a sun 108.

Figure 7:
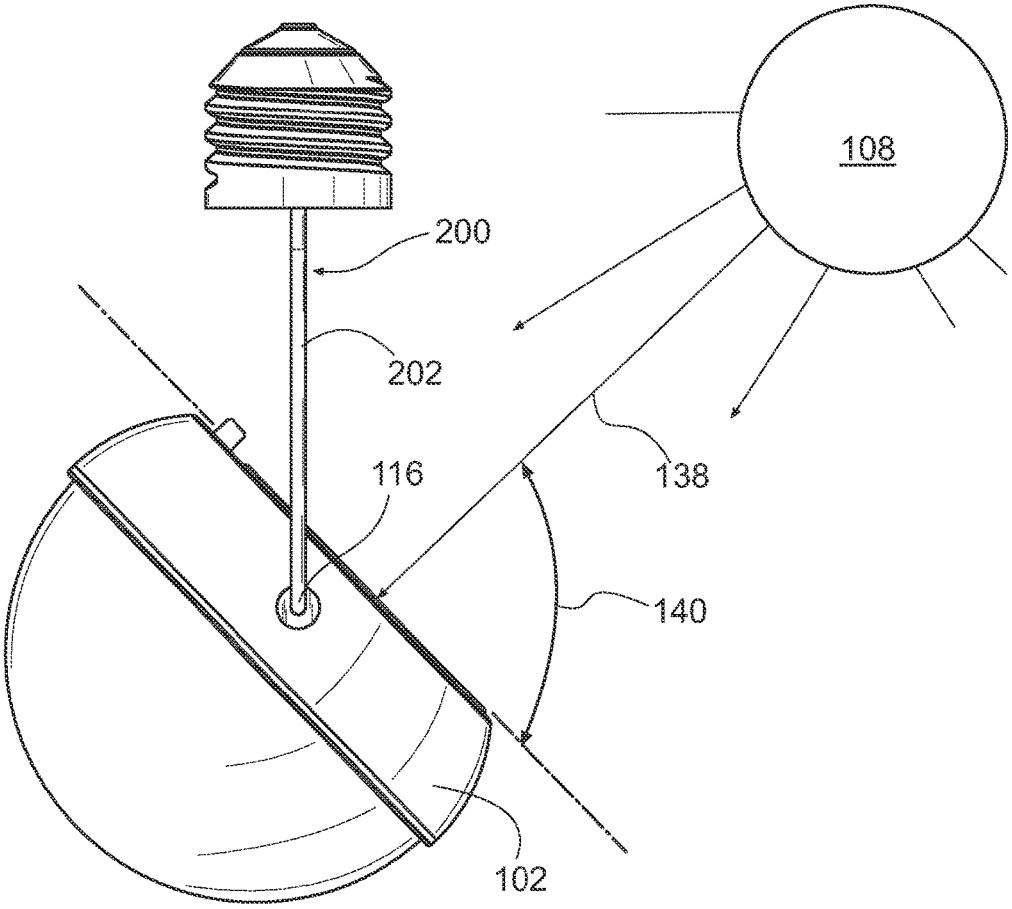
FIG. 7 is a right elevation view of the lamp shown adjusted to enable charging from the sun.

As shown in FIG. 7, the sun 108 emits energy illustrated by individual ray 138 that is absorbed by the solar collector 106 of the adjustable solar-charged lamp 100. To achieve maximum solar collection, the solar collector 106 is selectively repositionable so that each ray 138 hits the solar collector 106 at an angle of intersection 140 close to ninety degrees, in other words, so that the ray 138 is perpendicular to the solar collector 106. The adjustable nature of the solar-charged lamp 100 allows the housing 102 to be adjusted relative to the hanger assembly 200. The frictional force imparted by the yoke 202 on the housing 102 permits the angle of intersection 140 to be maintained. It should be noted that in practice, the orientation of the entire adjustable solar-charged lamp 100 may be adjusted through the course of one day's charging; however, the adjustment is greatly simplified by being able to adjust the angle of intersection 140 by pivoting the housing 102 about the pivot axis 116.

Figure 8:
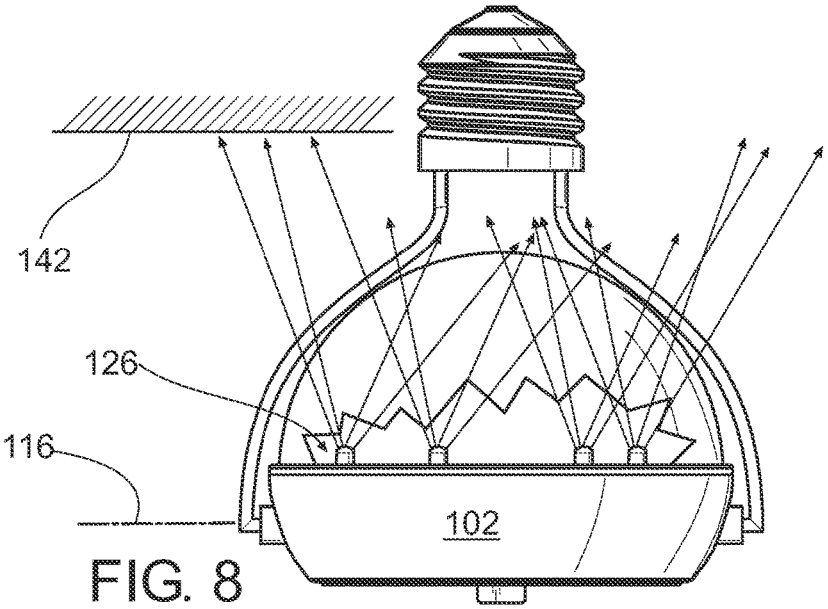
FIG. 8 is a front elevation view of the lamp shown with the housing adjusted to direct light on a target.
Figure 9:
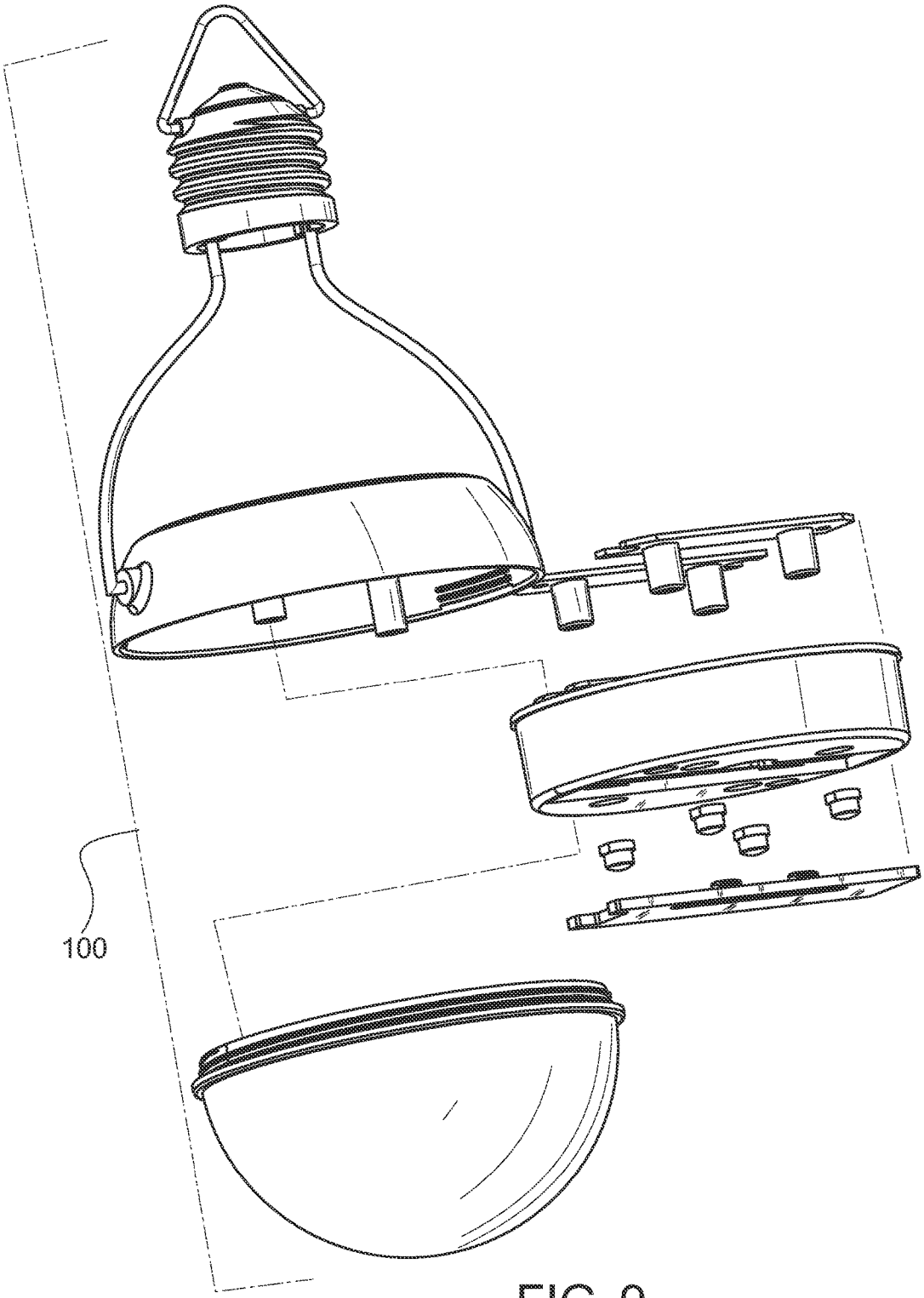
FIG. 9 is another exploded isometric view of the lamp.

As shown in FIG. 8, ability to pivot the housing 102 about the pivot axis 116 is useful not only during the charging, as illustrated in FIG. 7, but during illumination of an environment. For example, the housing 102 can be adjusted to direct light emitted from the light emitting device 126 toward a target 142. This target 142 may be a work surface, a book, a kitchen utensil, or any of an infinite number of tools and objects with which humans interface daily. This ability to selectively direct and aim the light greatly reduces the quantity of light required to perform tasks.

Having described one example of the adjustable solar-charged lamp 100, an overview of using the lamp 100 will now be provided. With reference to FIG. 1, the lamp 100 is placed in a location where a light source, such as the sun 108, can project light onto the solar collector 106. Light received by the solar collector 106 is converted into electricity and stored in the battery. After a sufficient amount of charging, the lamp 100 can be moved to a dark location, such as a windowless room in a dwelling, and activated to illuminate the room. During illumination of the room, energy stored in the battery is transferred to the light emitting device 126. This process can continue repeatedly as desired by the user.

The adjustable solar-charged lamp 100 can be provided with a photodetector for controlling illumination depending on environmental conditions.

What is claimed is:

1. An adjustable solar-charged lamp, comprising:

a housing that includes a first side, an oppositely disposed second side, a first hole disposed on the first side of the housing, and a second hole disposed on the second side of the housing opposite to the first side of the housing such that first and second holes are coaxial and define a pivot axis between the first and second holes;

a light emitting device disposed on the first side of the housing;

a solar collector disposed on the second side of the housing; and a yoke attached to the housing, including a first arm that pivotally engages the housing at the first hole, and including a second arm that pivotally engages the housing at the second hole, wherein the yoke is made of a round stock, wherein the second arm is a mirror-copy of the first arm, wherein the housing is disposed between the first and second arms and rotates about the pivot axis between the first and second arms, wherein the first arm frictionally engages the housing and the second arm frictionally engages the housing so the yoke imparts a frictional force with the housing to frictionally engage the housing at different orientations relative to the yoke, wherein the housing rotates about the pivot axis to the different orientations that include the housing in a horizontal position, wherein the housing, the light emitting device, and the solar collector rotate about the pivot axis to the different orientations and the frictional force between the yoke and the housing enables the yoke to frictionally engage the housing and maintain the housing at the different orientations so the solar collector is movable and adjustable for solar charging and so the light emitting device is movable to selectively direct and aim light emitted from the light emitting device.

2. The adjustable solar-charged lamp of claim 1, wherein the round stock is steel.

3. The adjustable solar-charged lamp of claim 1, wherein the round stock is manufactured by injection molding.

4. The adjustable solar-charged lamp of claim 1, wherein the yoke attaches to a cap, and a thread is formed on the cap and the thread mechanically attaches to a receiving socket.

5. The adjustable solar-charged lamp of claim 1, wherein the yoke attaches to a loop and the loop hangs the lamp.

6. The adjustable solar-charged lamp of claim 1, further comprising:

a lens that engages with the first side of the housing, wherein the housing, the lens, and the yoke collectively resemble a profile of an incandescent light bulb.

7. An adjustable solar-charged lamp, comprising:

a housing that includes a first side with a light emitting device, an oppositely disposed second side with a solar collector, a first hole disposed on a first side of the housing, and a second hole disposed on a second side of the housing that is opposite to the first side of the housing such that the first and second holes are coaxial, and a pivot axis that extends between the first and second holes; and a yoke that includes a first arm that pivotally engages the housing at the first hole, and that includes a second arm that pivotally engages the housing at the second hole, wherein the yoke is made of a round stock, wherein the second arm is a copy of the first arm, wherein the first arm frictionally engages the first hole and the second arm frictionally engages the second hole so the yoke imparts a frictional force on the housing to frictionally engage the housing at different orientations relative to the yoke, wherein the housing, the light emitting device, and the solar collector rotate about the pivot axis to the different orientations and the frictional force between the yoke and the housing enables the yoke to frictionally engage the housing and maintain the housing at the different orientations so the solar collector moves and adjusts for solar charging and so the light emitting device moves to selectively direct and aim light emitted from the light emitting device, and wherein the housing rotates about the pivot axis and between the first and second arms to the different orientations that include the housing in a horizontal position.

8. The adjustable solar-charged lamp of claim 7, wherein the round stock is steel.

9. The adjustable solar-charged lamp of claim 7, wherein the round stock is manufactured by injection molding.

10. The adjustable solar-charged lamp of claim 7, wherein the yoke attaches to a cap, and a thread is formed on the cap and the thread mechanically attaches to a receiving socket.

11. The adjustable solar-charged lamp of claim 7, wherein the yoke attaches to a loop and the loop hangs the lamp.

12. The adjustable solar-charged lamp of claim 7, further comprising:

a lens that engages with the first side of the housing, wherein the housing, the lens, and the yoke collectively resemble a profile of an incandescent light bulb.

13. An adjustable solar-charged lamp, comprising:

a housing that includes a first side with a light emitting device, a second side with a flat planar solar collector that is oppositely disposed from the first side, a first hole in a first side of the housing, and a second hole in a second side of the housing that is oppositely disposed from the first hole such that the first and second holes are coaxial and define a pivot axis that extends between the first and second holes; and a curved yoke that includes a first arm that fits into the first hole and pivotally connects to the first side of the housing and a second arm that fits into the second hole and pivotally connects to the second side of the housing, wherein the yoke is made of a round stock, wherein the second arm is a mirror copy of the first arm and includes a second pivot that fits into the second hole and includes two arcs, wherein the first arm frictionally engages the first hole and the second arm frictionally engages the second hole so the yoke imparts a frictional force on the housing to frictionally engage the housing at different orientations relative to the yoke, wherein the housing, the solar collector, and the light emitting device rotate about the pivot axis to the different orientations and the frictional force between the yoke and the housing enables the yoke to frictionally engage the housing and maintain the housing at the different orientations so the solar collector is movable and adjustable for solar charging and so the light emitting device is movable to aim light emitted from the light emitting device, and wherein the housing rotates about the pivot axis between the first and second arms to the different orientations that include the housing in a horizontal position.

14. The adjustable solar-charged lamp of claim 13, wherein the round stock is steel.

15. The adjustable solar-charged lamp of claim 13, wherein the round stock is manufactured by injection molding.

16. The adjustable solar-charged lamp of claim 13, wherein the yoke attaches to a cap, and a thread is formed on the cap and the thread mechanically attaches to a receiving socket.

17. The adjustable solar-charged lamp of claim 13, wherein the yoke attaches to a loop and the loop hangs the lamp.

18. The adjustable solar-charged lamp of claim 13, further comprising:

a lens that engages with the first side of the housing, wherein the housing, the lens, and the yoke collectively resemble a profile of an incandescent light bulb.

* * * * *